United States Patent [19]

Sours

[11] 4,441,419

[45] Apr. 10, 1984

[54] IMPRINTING DEVICE AND DIGIT WHEEL ASSEMBLY THEREFOR

[75] Inventor: William A Sours, Sauqoit, N.Y.

[73] Assignee: National Business Systems, Inc., Mississauga, Canada

[21] Appl. No.: 446,161

[22] Filed: Dec. 1, 1982

Related U.S. Application Data

[63] Continuation of Ser. No. 310,905, filed as PCT US/80/01418, Oct. 22, 1980, § 102(e) Sep. 9, 1981, publish as WO 82/01344, Apr. 29, 1982, abandoned.

[51] Int. Cl.[3] ..... B41F 3/04

[52] U.S. Cl. ..... 101/45; 101/56; 101/110

[58] Field of Search ..... 101/45, 56, 110, 111, 101/269–274

[56] References Cited

U.S. PATENT DOCUMENTS

| | | | |
|---|---|---|---|
| 3,417,691 | 12/1968 | Kuboxy | 101/269 |
| 3,508,488 | 4/1970 | Maul et al. | 101/45 |
| 3,696,740 | 10/1972 | Glatt | 101/111 |
| 3,709,144 | 1/1973 | Sims | 101/45 |
| 3,744,411 | 7/1973 | Becker | 101/111 |
| 3,800,700 | 4/1974 | McInnis et al. | 101/269 |
| 3,818,826 | 6/1974 | Geiger | 101/45 |
| 3,826,190 | 7/1974 | Zofohak | 101/56 X |
| 3,881,411 | 5/1975 | Araki et al. | 101/45 |
| 4,044,675 | 8/1977 | Deisting | 101/45 X |
| 4,324,178 | 4/1982 | Barbour | 101/45 |

*Primary Examiner*—Edward M. Coven
*Attorney, Agent, or Firm*—Irons & Sears

[57] ABSTRACT

A digit wheel assembly for use in connection with a variable imprinting device comprises a plurality of digit wheels rotatably mounted on a common fixed digit wheel shaft, each of said digit wheels having raised printing indicia spaced along the circumference thereof; a plurality of thumbwheels rotatably mounted on a common fixed thumbwheel shaft, said thumbwheels being equal in number to said plurality of digit wheels; a first plurality of sprockets equal in number to said plurality of digit wheels, each of said first plurality of sprockets being operatively associated with one of said digit wheels so as to rotate therewith; a second plurality of sprockets equal in number to said plurality of digit wheels, each of said second plurality of sprockets being operatively associated with one of said thumbwheels so as to rotate therewith; and endless flexible drive means connecting each of said first plurality of sprockets to one of said second plurality of sprockets, whereby the rotational position of a given one of said digit wheels may be adjusted by rotation of the corresponding one of said thumbwheels.

6 Claims, 6 Drawing Figures

IMPRINTING DEVICE AND DIGIT WHEEL ASSEMBLY THEREFOR

This application is a continuation of application Ser. No. 310,905, filed as PCT U.S./80/01418, Oct. 22, 1980, §102(e) Sep. 9, 1981, publish as WO82/01344, Apr. 29, 1982, abandoned.

BACKGROUND OF THE INVENTION

1. Field of the Invention

The present invention relates generally to devices for imprinting fixed and variable information on business forms and similar documents, and is particularly concerned with an improved digit wheel assembly for use in connection with devices of this nature. The invention also embraces an improved cantilever-type imprinter head configuration which permits oversized forms to be accommodated by the imprinting device.

2. Description of the Prior Art

Imprinting devices for transferring to a printed form the fixed and variable information relating to a business transaction are well known and have been in general use in various types of retail establishments for many years. Typically, the purchaser presents the retailer with a plastic credit or charge card, upon which are embossed the customer's name, address, account number, and other pertinent information in raised letters. The retailer places the card, together with a prepared form containing one or more carbon duplicates, into the imprinting device. In the imprinting device, a platen roller is rolled over the card and prepared form in order to transfer a printed image of the information on the card to the form. Generally, the imprinter also includes a permanently-affixed metal plate (sometimes referred to as the "merchant plate") containing the name and address of the retail establishment in raised lettering, so that this information is transferred to the form at the same time.

In the simplest types of imprinters, the foregoing "fixed" type of information (plus, in some cases, the form by the imprinter. The remaining "variable" information, such as the price of the goods or services purchased, the applicable taxes, and so on, must then be added to the form manually. This is not only inconvenient at the point of sale, but also makes it difficult or impossible to process the forms automatically using optical character recognition equipment. As a result, each form must be clerically read and keyed into a computer at the processing center before the purchaser can be billed. This, of course, is both time-consuming and susceptible to errors.

In an effort to overcome these disadvantages, the so-called "variable imprinter" has been developed. In this type of imprinter, the variable information (i.e., that information which will normally change for each successive transaction, such as the total amount of the sale) is preset on the machine before the imprinting operation is carried out, and is transferred to the prepared form at the same time as the customer's account information and the name and location of the retail establishment is transferred. This is usually done by means of an adjustable set of digit wheels which are in one way or another brought into contact with the form during the imprinting operation. A common arrangement is to install the digit wheel assembly within the imprinter housing so that it protrudes slightly through a slot or cut-out in the print bed. Adjustment of the digit wheel settings is usually accomplished by means of sliding gear racks which cooperate with gear teeth formed on the sides of the individual digit wheels. The gear racks, in turn, are usually moved by a set of slidable tabulator keys which are received in long slots on the front panel of the imprinter. Imprinting machines of this general type are disclosed, for example, in U.S. Pat. Nos. 3,138,091 and 3,521,556.

Although variable imprinters constructed along the foregoing lines have enjoyed significant commercial success, numerous problems still remain. Not the least of these has to do with the rack-and-pinion system used for setting the digit wheels, which is a rather cumbersome arrangement from the standpoint of manufacture as well as operation. The gear racks, in particular, are rather large special-purpose metal parts which are expensive to manufacture, and which therefore add significantly to the cost (and weight) of the finished unit. In addition, the necessary length of the gear racks tends to render imprinters of this type rather large in overall dimensions, which is a distinct disadvantage in retail establishments where counter space is at a premium. A further disadvantage of the rack-and-pinion adjustment, albeit perhaps of a more subjective nature, has to do with the significant degree of sliding friction that is inherent in mechanical arrangements of this sort. As a result of this, imprinters of the rack-and-pinion type tend to have a rather coarse "feel" from the standpoint of the effort required to make the required adjustments.

A further poblem that has not been adequately solved in presently available imprinting machines has to do with the sizes of forms that these machines will accept. Conventional "flatbed" type imprinters, in which the platen rollers are contained in a movable imprinter head that is supported by rollers at two edges of the imprinter unit, are usually capable of accepting only certain size forms, such as the usual 51- and 80-column credit card form sheets. Larger-size forms, such as a standard cash register form, cannot be accommodated. For this reason, it is common for retailers to have on hand a second imprinter of the "open head" type. In this type of unit, the imprinter head is operated by means of a plunger-type handle and is attached to the base of the unit by means of a hinge, which allows the imprinter head to be pivoted away from the base in order to accommodate the larger form. Open head imprinters are generally more expensive than the flatbed units, however, and the print quality produced by open head machines is often not as good as that produced by flatbed machines. These factors tend to make open head units unattractive to retailers despite the added versatility they provide.

SUMMARY OF THE INVENTION

In accordance with the present invention, a digit wheel assembly for use in connection with a variable imprinter comprises a plurality of digit wheels rotatably mounted on a common digit wheel shaft, each of the digit wheels having raised printing indicia spaced along its circumference; a plurality of thumbwheels rotatably mounted on a common fixed thumbwheel shaft, said thumbwheels being equal in number to the plurality of digit wheels; a first plurality of sprockets equal in number to the plurality of digit wheels, each of said first plurality of sprockets being operatively associated with one of said digit wheels so as to rotate therewith; a second plurality of sprockets equal in number to the plurality of digit wheels, each of said second plurality of sprockets being operatively associated with one of the thumbwheels so as to rotate therewith; and endles flexible drive means connecting each of said first plurality of sprockets to one of said second plurality of sprockets, whereby the rotational position of a given one of the digit wheels may be adjusted by rotation of the corresponding one of the thumbwheels. In a preferred arrangement, the endless flexible drive means comprises a plurality of bead chains, each comprising a series of connected spherical segments, and each of the first and second plurality of sprockets includes a number of adjacent semi-spherical recesses evenly spaced around the periphery thereof for receiving the connected spherical segments of one of the bead chains.

The foregoing arrangement produces an imprinter which, due in large part to the elimination of the metal gear racks, is smaller, lighter, less expensive to manufacture, and more convenient to operate. Unlike the metal gear racks of prior art imprinters, which had to be at least as long as the operative circumference of the digit wheel gear faces (and were usually much longer than this), the bead chain linkage of the present invention carries no inherent size penalty. The digit wheels are adjusted by a compact set of thumbwheels, rather than by a much larger panel of sliding tabulator keys. The overall weight of the unit is also reduced markedly, since the bead chain themselves (which may be of the type and approximate size commonly found on key chains) are much lighter in weight than the metal gear racks they replace, and since the additional parts requirement (e.g., for sprockets and the like) is minimal. Moreover, the required bead chains are of a commonly available and inexpensive type, which produces an important cost advantage over units employing the specially-manufactured gear racks. Finally, the bead chain linkage described herein is not inherently frictionprone, and produces a smoother and more effortless adjustment of the digital wheel settings than is possible with most of the imprinter units heretofore available.

A further aspect of the present invention resides in the provision of a variable imprinter which comprises a generally rectangular base enclosure having a substantially flat upper surface for supporting a document to be imprinted, said flat upper surface having a cut-out formed therein; an adjustable digit wheel assembly for selecting the variable information to be imprinted, said digit wheel assembly being mounted within the base enclosure and in alignment with the cut-out section in the upper surface thereof, such that the periphery of the digit wheel assembly is placed in printing contact with the document to be imprinted during an imprinting operation; and a generally L-shaped imprinter head which is slidable over at least a portion of the upper surface of the base enclosure including the cut-out section in order to carry out an imprinting operation. The imprinter head comprises a horizontal portion containing at least one rotatably mounted platen roller having its axis transverse to the sliding direction of the imprinter head, and a vertical portion connected to one end of the horizontal section, said vertical portion containing means for slidably attaching the imprinter head to only one side of the base enclosure, the opposite end of the horizontal portion of the imprinter being left open to accommodate oversized documents. In a preferred arrangement, the side of the base enclosure to which the imprinter head is slidably attached includes free upper and lower edges, and the attachment means comprises at least two upper roller bearings rotatably mounted in the vertical portion of the imprinter head for rollingly engaging the free upper edge of said side of the base enclosure, and at least two lower roller bearings rotatably mounted in the vertical portion of the imprinter head for rollingly engaging the free lower edge of said side of the base enclosure. The foregoing arrangement results in a cantilever-type construction for the movable imprinter head which allows forms of any size to be accommodated by the imprinter unit.

BRIEF DESCRIPTION OF THE DRAWINGS

These and other objects, advantages and novel features of the present invention will be more readily apprehended from the following detailed description when read in conjunction with the appended drawings, in which.

Throughout the drawings, like reference numerals have been used to designate like parts.

DETAILED DESCRIPTION OF THE PREFERRED EMBODIMENT

Figure 1:
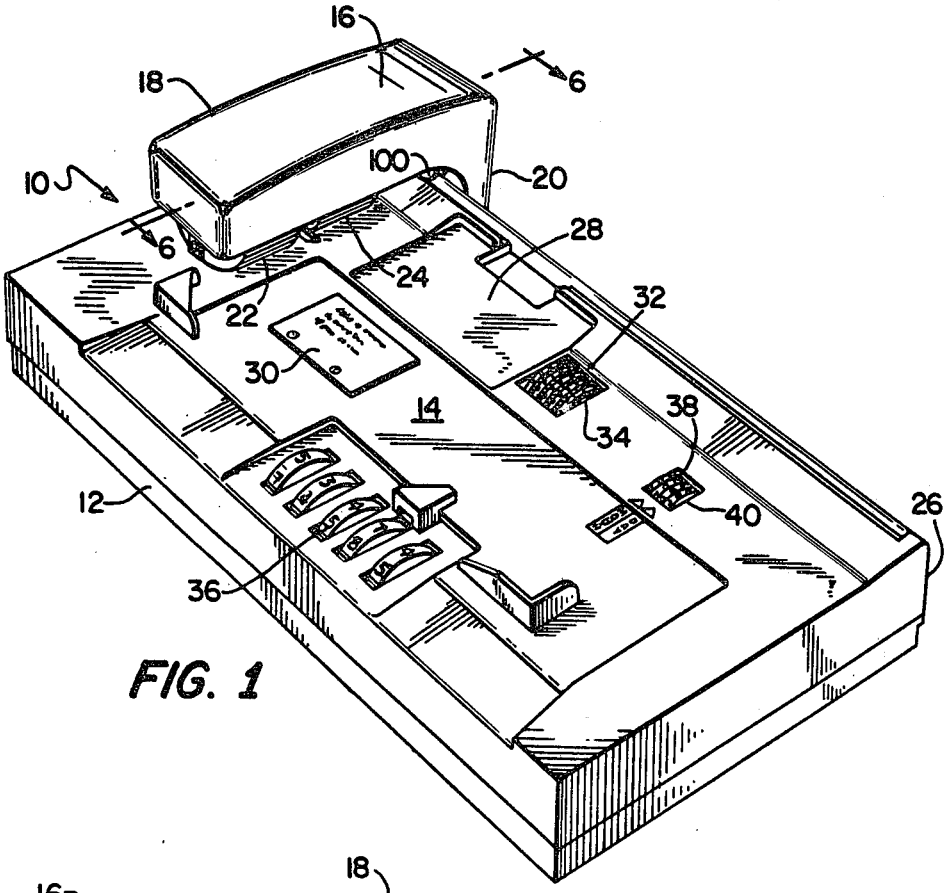
FIG. 1 is a top perspective view of a variable imprinting unit constructed in accordance with the principles of the present invention.

A variable imprinting unit 10 constructed in accordance with the principles of the present invention is illustrated in top perspective view in FIG. 1. The imprinting unit 10 comprises a generally rectangular base enclosure 12 which includes a substantially flat upper surface 14 for supporting a form or document to be printed (not shown), and a movable imprinter head 16 which is slidable over the rear portion of the upper surface 14 in a manner to be described hereinafter. The imprinter head 16 is generally L-shaped and includes a horizontal front portion 18 and a vertical rear portion 20. The horizontal portion 18 of the imprinter head carries two rotatably mounted platen rollers 22 and 24 having their axes transverse to the sliding direction of the imprinter head 16. The vertical portion 20 of the imprinter head, only a part of which is visible in FIG. 1, includes roller bearings for slidably attaching the imprinter head to the rear side 26 of the base enclosure in a manner to be described in detail hereinafter. The end of the horizontal portion 18 of the imprinter head opposite the rear side 26 of the base is left open, as shown in the drawing.

With reference to FIG. 1, the upper document supporting surface 14 of the imprinter base 12 is provided with a recess for receiving a customer credit or charge card (not shown) and a permanently-affixed merchant plate 30 which will normally be embossed with the name and location of the retail merchant. A set of digit wheels 32, five of which are shown in the illustrated embodiment, protrude upwardly through a rectangular cut-out 34 that is formed in the upper surface 14 of the base enclosure 12. As will be described in more detail shortly, the five digit wheels 32 carry the variable data (i.e., total amount due) that is to be transferred to the document to be imprinted, and are adjusted by means of a corresponding set of five thumbwheels 36 that are recessed in the front portion of the base enclosure 12. It is to be understood, of course, that a greater or lesser number of digit wheels 32 and thumbwheels 36 may be provided, depending upon the desired data recording capacity of the imprinting unit.

Each of the thumbwheels 36 is provided with legible indicia along the circumference thereof, as shown, which is representative of the raised printing indicia on the corresponding one of the digit wheels 32. In addition, the thumbwheels 36 will normally be provided with knurled or raised portions along their circumference in order to facilitate manual rotation by the user of the imprinting device.

Also visible in FIG. 1 is a further set of digit wheels 38, which protrude upwardly through a second rectangular cut-out 40 formed in the upper surface 14 of the imprinter base 12. The digit wheels 38 are used for indicating the month and day of the transaction on the document being imprinted. The month and day digit wheels 38, which do not need to be adjusted as often as the variable-data digit wheels 32, are set in the conventional manner by direct finger pressure rather than by a separate set of thumbwheels.

Figure 2:
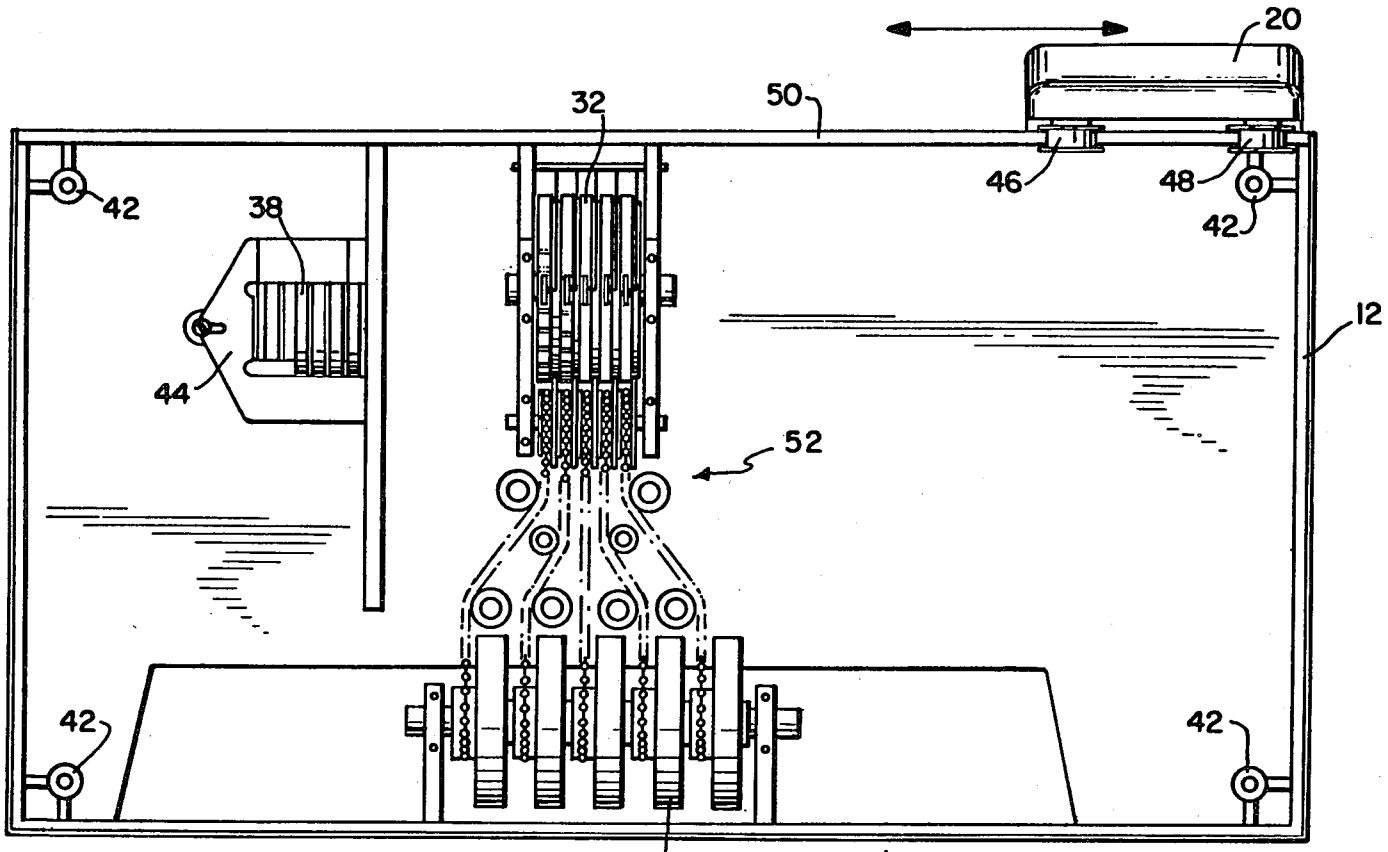
FIG. 2 is a bottom plan view of the imprinter unit of FIG. 1.

FIG. 2 is a bottom plan view of the imprinting unit 10 of FIG. 1, illustrating the internal components thereof. The base enclosure 12 of the imprinter, which is preferably made of a high-impact plastic material, is provided with integral threaded bosses 42 at each inside corner thereof for securing a bottom closure plate (not shown) to the bottom of the base enclosure by means of screws or other appropriate fasteners. Suitable rubber feet or suction cups (not shown) may also be secured to the bottom closure plate at the locations of the bosses 42. Also visible in FIG. 2 is the lower part of the vertical portion 20 of the imprinter head 16, which will be seen to carry two flanged roller bearings 46 and 48 for rollingly engaging the free lower edge 50 of the rear side 26 (FIG. 1) of the imprinter base enclosure 12.

With further reference to FIG.2, the month-day digit wheels 38 will be seen to be supported by a bracket 44 which is secured to the interior of the base enclosure 12 in any suitable manner. To the right of the month-day digit wheels 38 in FIG. 2 is the digit wheel assembly 52 for the variable information that is entered prior to each imprinting operation. The digit wheel assembly 52 includes the digit wheels 32, thumbwheels 36, and a novel mechanical linkage for rotatably interconnecting each thumbwheel with a corresponding one of the digit wheels 32, as will now be described in detail with reference to FIGS. 3–5.

Figure 3:
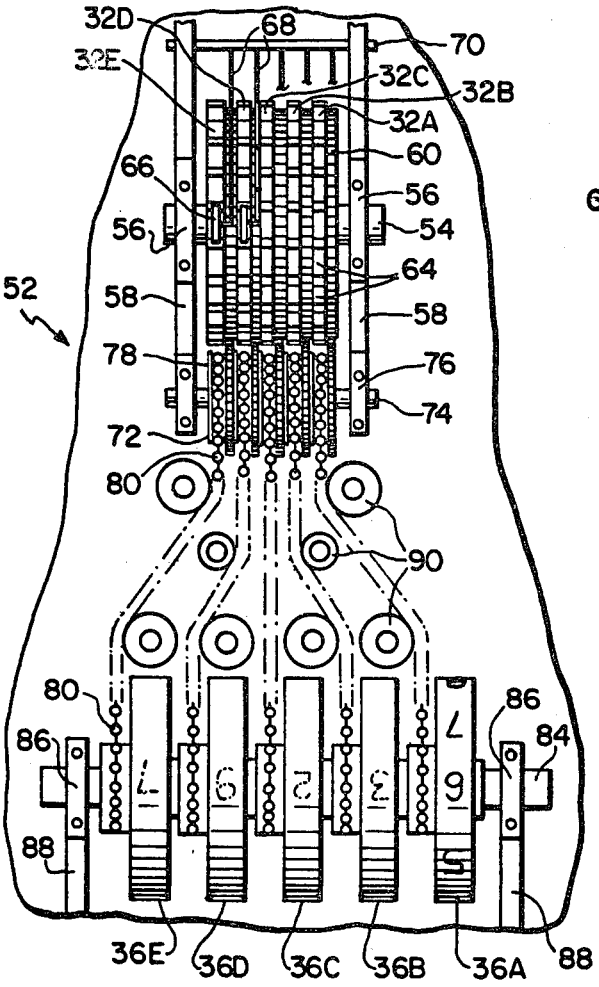
FIG. 3 is a bottom view of the digit wheel assembly of the imprinter unit of FIGS. 1 and 2.

FIG. 3 is an enlarged bottom view of the digit wheel assembly 52 of FIG. 2, illustrating the various components thereof in somewhat greater detail. Each of the five digit wheels 32A–32E is provided with raised printing indicia spaced along a part of its circumference, although these indicia have been omitted from the drawing for clarity. The digit wheels 32A–32E are all rotatably mounted on a common fixed shaft 54, referred to as the digit wheel shaft, which is in turn retained firmly between bar-shaped clamps 56 and a fixed support structure 58. The support structure is preferably integral with the base enclosure 12 of the imprinter, as may be accomplished by molding the base 12 and support structure 58 as a one-piece plastic unit. The support structure 58 may be provided with suitable recesses for receiving the ends of the digit wheel shaft 54, these recesses being closed off by the attachment of the bar-shaped clamps 56.

Figure 4:
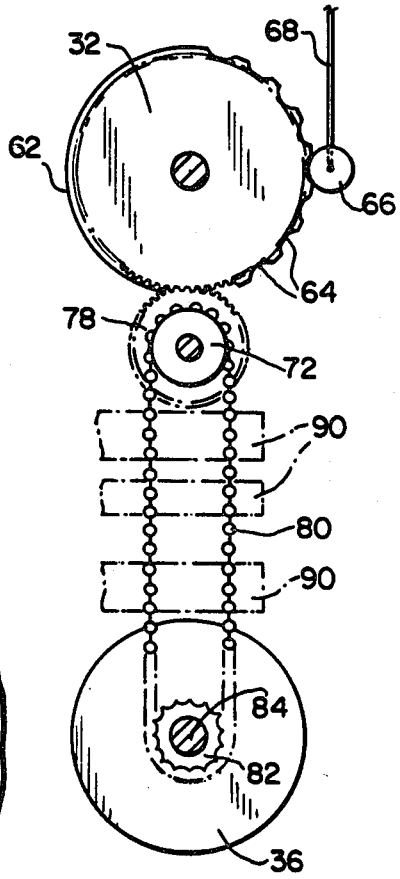
FIG. 4 is a side view of the digit wheel assembly of FIG. 3.

With further reference to FIG. 3, each of the digit wheels 32A–32E will be seen to include an integral gear face portion 60 characterized by a set of radially projecting gear teeth affixed to one side of the digit wheel. The digit wheels and gear face portions may be one-piece metal structures, as is conventional, or may alternatively be molded as one-piece structures from a suitable plastic material in order to reduce the manufacturing cost and weight of the imprinter unit. In either case, the digit wheels 32A–32E are formed in a manner such that the raised printing indicia cover only about half the total circumference of each digit wheel. This is indicated generally as the area 62 in FIG. 4, which is a side view of the digit wheel assembly 52 of FIG. 3. The remaining part of the circumference of each digit wheel 32 is formed with a series of recesses or detents 64 (visible most clearly in FIG. 4), which cooperate with a spring-biased detent mechanism that functions to establish a number of predetermined rotational positions for each of the digit wheels. This assures that the selected digit on the periphery of each of the digit wheels is properly aligned with respect to the upper surface 14 of the imprinter base (FIG. 1) during the imprinting operation. As shown in FIGS. 3 and 4, the detent mechanism comprises a number of small detent rollers 66 which are biased against the detents 64 in the digit wheels 32 by means of spring bars or wires 68, which may be made of spring-tempered steel or some other suitable material. The proximal ends of the spring bars 68 are affixed to a support bar 70, which is in turn affixed at each of its ends to the fixed support structure 58.

With continued reference to FIGS. 3 and 4, a plurality of sprockets 72 equal in number to the digit wheels 32 (5 in the present example) are rotatably mounted on a fixed common shaft 74, hereinafter referred to as the sprocket shaft. The sprocket shaft 74 is firmly retained between the fixed support structure 58 and the bar-shaped clamps 76 in the same manner as the digit wheel shaft 54. As indicated in FIGS. 3 and 4, each of the sprockets 72 is provided with an integral gear face portion 78 characterized by a set of radially projecting gear teeth affixed to one side of the sprocket. The sprocket and gear face portions may be one piece metal structures, or may alternatively be molded as one-piece structures from a suitable plastic material in the interest of minimizing weight and cost. As indicated in the drawings, the gear face 78 of each of the sprockets 72 meshes with the gear face 60 of one of the digit wheels 32, so that the sprockets 72 and digit wheels 32 will rotate in synchronism. The main body of each of the sprockets 72, adjacent to the gear face portion 78, is provided with a number of adjacent semi-spherical recesses evenly spaced around the periphery thereof for receiving the connected spherical segments of one of the endless bead chains 80.

With continued reference to FIGS. 3 and 4, the bead chains 80 will be seen to interconnect the sprockets 80 to a similar set of sprockets 82 affixed to the sides of the thumbwheels 36A–36E. The sprockets 82 may be metal structures that are rigidly affixed to the sides of the thumbwheels 36, which will typically be made of a plastic material, or alternatively the sprockets 82 and thumbwheels 36 may be molded as one-piece units from a suitable plastic material. In either case, the thumbwheels 36 and sprockets 82 are rotatably mounted on a common fixed shaft 8, referred to as the thumbwheel shaft, which is in turn retained between a bar-shaped clamp 86 and a fixed support structure 88 in the same manner as the shafts 54 and 74.

As a consequence of the foregoing arrangement, rotation of the individual thumbwheels 36A–36E by the user of the imprinting device will be transmitted by virtue of the bead chains 80, to the sprockets 72 on the sprocket shaft 74. Rotation of the sprockets 72 will be transmitted, in turn, to the digit wheels 32A–32E by virtue of the meshing gear faces 78 and 60 affixed to these elements. In this way, the digit wheels 32A–32E may be set to indicate the desired variable data merely by rotating the individual thumbwheels 36A–36E, whereby the sliding gear racks and tabulator keys of previously known types of imprinter units are dispensed with.

Since the center-to-center spacing between adjacent digit wheels 32 on the digit wheel shaft 54 will usually be smaller than the center-to-center spacing between adjacent thumbwheels 36 on the thumbwheel shaft 84, the bead chains 80 must be allowed to fan out as they trasverse the distance between the sprockets 72 and the thumbwheel sprockets 82. If the bead chains were permitted to travel in a perfectly straight line, however, all the chains except the central one would not be in alignment with the plane of the sprockets at their points of contact with the sprockets. This would tend to cause poor engagement between the sprockets and bead chains, and might also result in periodic accidental disengagement. To prevent this, a number of vertically extending bosses 90 are provided to act as fixed guide members for causing the four outer bead chains to follow a non-linear path between the two sets of sprockets 72 and 82. In particular, the bosses 90 cause these chains to align themselves with the planes of the sprockets 72 and 82 near their points of contact with these sprockets, thereby avoiding the problems referred to previously.

Figure 5:
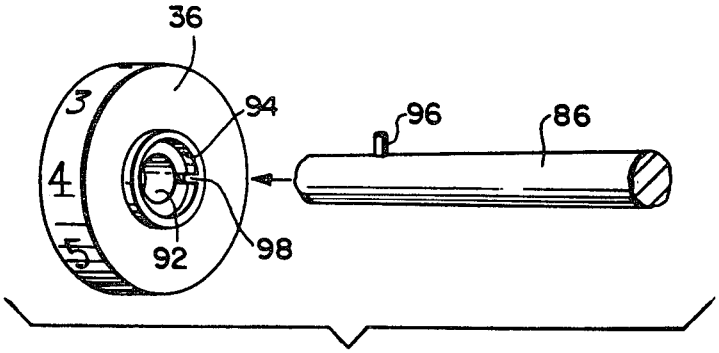
FIG. 5 is an exploded view illustrating the relationship of one of the thumbwheels and the thumbwheel shaft in the digit wheel assembly of FIGS. 3 and 4.

Since the raised printing indicia on the digit wheels 32 cover only about half of the total circumference of the digit wheels, the effective drive ratio among the sprockets 72 and 82 and gear faces 78 and 60 is chosen such that a full rotation of one of the thumbwheels 36 will cause only a half rotation of the corresponding one of the digit wheels 32. This is implemented most easily by making the sprockets 72 and 82 the same size, and by choosing the diameter of the gear faces 60 to be twice as large as the diameter of the gear faces 78. In addition, it is desirable to prevent the thumbwheels 36 from being rotated by an amount greater than 360°, since the digit wheel detents 64 might otherwise be inadvertently rotated to the printing position at the upper surface 14 of the imprinter base (FIG. 1) as the user attempts to select a desired digit. To ensure that this does not happen, the arrangement shown in FIG. 5 is employed. In particular, each of the thumbwheels 36 is provided with a stepped central hole comprising adjacent first and second hole sections 92 and 94. The first hole section 92 conforms in size to the diameter of the thumbwheel shaft 86, and the second hole section 94 has a diameter greater than that of the first hole section. An external projection 96 is formed on the thumbwheel shaft 86 at the location of each of the thumbwheels 36A–36E that is mounted thereon (for convenience, only one such projection has been shown on the thumbwheel shaft in FIG. 5). Within the second hole section of each of the thumbwheels 36, an internal projection 98 is formed. The dimensions of the two projections 96 and 98 are such that, when the thumbwheel 36 is in position on the shaft 86, the internal projection 98 of the thumbwheel will be brought into obstructing contact with the corresponding external projection 96 on the thumbwheel shaft at a particular rotational position of the thumbwheel, thereby preventing further rotation of the thumbwheel. In this way, rotation of the thumbwheel by an amount greater than 360° is not possible.

Figure 6:
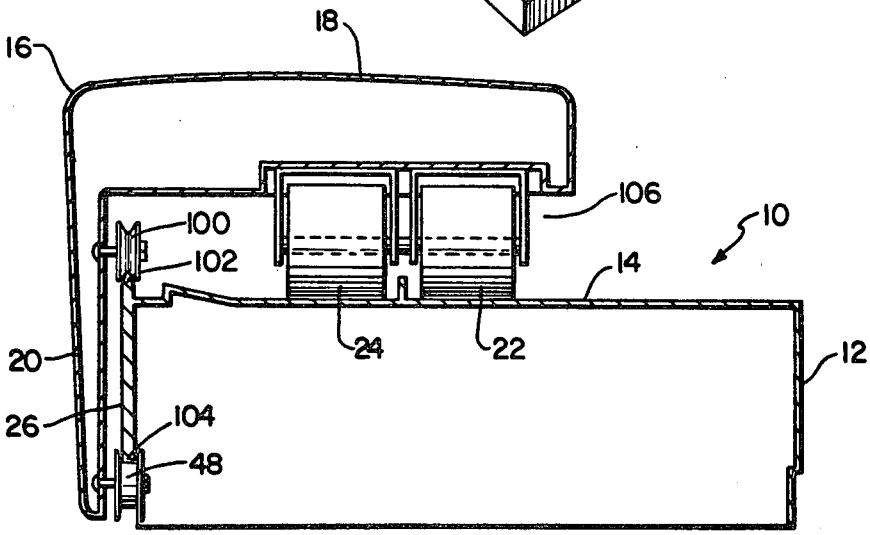
FIG.6 is a cross-sectional view of the imprinting unit taken along line 6—6 in FIG. 1.

A further important feature of the variable imprinter of the present invention resides in the manner in which the imprinter head 16 is mounted with respect to the base 12 of the imprinter unit. This may best be appreciated by reference to FIG. 6, which is a cross-sectional view taken along the line 6—6 in FIG. 1. As shown in the drawing, the L-shaped imprinter head 16 is slidably attached to only the rear panel 26 of the imprinter base enclosure 12 by means of two upper roller bearings (only one of which is shown in the drawing at 100) and two lower roller bearings (one of which is shown in FIG. 6 at 48, and both being shown in FIG. 2 at 46 and 48). The upper rollers 100 are rotatably mounted in the vertical portion 20 of the imprinter head for rollingly engaging the free upper edge 102 of the rear panel 26 of the base enclosure 12. The lower rollers 46 and 48 are rotatably mounted in a similar manner in the vertical portion 20 of the imprinter for rollingly engaging the free lower edge 104 of the rear panel 26 of the base enclosure 12. As result of this arrangement, the imprinter head 16 is fully supported for sliding movement along the rear portion of upper surface 14 of the imprinter base in a direction transverse to the axis of the platen rollers 22 and 24, whereby the periphery of the digit wheel assembly is placed in firm printing contact with the document to be imprinted during the imprinting operation. At the same time, however, this arrangement leaves the forward portion 106 of the imprinter head open and unobstructed by any supporting apparatus. This has the advantage of permitting oversized documents (i.e., documents extending beyond the imprinter head 16 in the direction toward the front of the imprinter) to be imprinted by the imprinter unit 10 and therefore avoids the document size restrictions that have seriously limited the versatility of previously available imprinting devices.

What is claimed is:

1. A digit wheel assembly for use in connection with a variable imprinting device, comprising:

(a) a plurality of digit wheels rotatably mounted on a common fixed digit wheel shaft, each of said digit wheels having raised printing indicia spaced along the circumference thereof;

(b) a plurality of thumbwheels rotatably mounted on a common fixed thumbwheel shaft, said thumbwheels being equal in number to said plurality of digit wheels, (c) a first plurality of sprockets equal in number to said plurality of digit wheels, each of said first plurality of sprockets having multiple adjacent semi-spherical recesses evenly spaced around the periphery thereof, and each of said first plurality of sprockets being operatively associated with one of said digit wheels so as to rotate therewith;

(d) a second plurality of sprockets equal in number to said plurality of digit wheels, each of said second plurality of sprockets having multiple adjacent semi-spherical recesses evenly spaced around the periphery thereof, each of said second plurality of sprockets being operatively associated with one of said thumbwheels so as to rotate therewith; and said second plurality of sprockets having different center-to-center spacing from the center-to-center spacing of said first plurality of sprockets, (e) a plurality of endless bead chains equal in number to said plurality of digit wheels, each of said endless bead chains comprising a series of connected spherical segments, and each endless bead chain connecting one of said first plurality of sprockets to one of said second plurality of sprockets by having spherical segments for each endless bead chain being retained in said semi-spherical recesses of said first and second plurality of sprockets; and, (f) bosses mounted vertically with respect to said digit wheel shaft and said thumbwheel shaft for causing those endless bead chains which connect sprockets not aligned with one another to bend so that each of said endless bead chains is maintained in positions which result in the linear relationship of said spherical segments, at said sprockets, to be perpendicular to the rotational axes of said first and second plurality of sprockets;

whereby synchronization is maintained between the rotational position of said digit wheel operatively associated with said first sprocket and the rotational position of said thumbwheel operatively associated with said second sprocket.

2. A digit wheel assembly in accordance with claim 1, wherein each of said second plurality of sprockets is rigidly affixed to the corresponding one of said thumbwheels, and wherein (a) each of said digit wheels includes an integral gear face portion characterized by a set of radially projecting gear teeth, (b) each of said first plurality of sprockets includes an integral gear face portion characterized by a set of radially projecting gear teeth, said first plurality of sprockets being mounted on a common fixed sprocket shaft which is positioned such that the gear face of each of said first plurality of sprockets meshes with the gear face of the corresponding one of said digit wheels.

3. A digit wheel assembly in accordance with claim 2, wherein means is provided for restricting the angular rotation of each of said thumbwheels to an amount not greater than 360°.

4. A digit wheel assembly in accordance with claim 3, wherein each of said thumbwheels contains a stepped central hole comprising adjacent first and second hole sections, said first hole section conforming in size to the diameter of said thumbwheel shaft, and said second hole section having a diameter greater than that of said first hole section, and wherein said restricting means comprises:

(a) an external projection formed on said thumbwheel shaft at the location of each of the plurality of thumbwheels mounted thereon; and (b) an internal projection formed within the second hole section of each of said thumbwheels, the dimensions of said internal and external projections being such that the internal projection of each of said thumbwheels will be brought into obstructing contact with the corresponding external projection on the thumbwheel shaft at a particular rotational position of said thumbwheel, whereby further rotation of said thumbwheel is prevented.

5. A digit wheel assembly in accordance with claim 4, wherein each said digit wheels is provided with spring-biased detent means to establish a number of predetermined rotational positions for each of said digit wheels.

6. A digit wheel assembly in accordance with claim 5, wherein each of said thumbwheels is provided with legible indicia along the circumference thereof representative of the raised printing indicia on the circumference of the corresponding one of the digit wheels.

* * * * *

UNITED STATES PATENT AND TRADEMARK OFFICE

CERTIFICATE OF CORRECTION

PATENT NO. : 4,441,419

DATED : April 10, 1984

INVENTOR(S) : William A. Sours

It is certified that error appears in the above-identified patent and that said Letters Patent is hereby corrected as shown below:

Column 1, line 40, after "the", insert "date of the transaction) is all that is transferred to the".

Column 4, line 33, after "in" (first occurrence), insert "a".

Column 7, line 19, delete "trasverse", and insert "traverse" therefor.

Column 8, line 51, delete " , " and insert " ; " therefor.

Column 8, line 24, after "As", insert -- a --.

Column 10, line 29, after "each", insert -- of --.

Signed and Sealed this

*Fourth* Day of *December 1984*

[SEAL]

*Attest:*

*Attesting Officer*

GERALD J. MOSSINGHOFF

*Commissioner of Patents and Trademarks*